US010563152B2

(12) United States Patent
Schramm, Jr. et al.

(10) Patent No.: US 10,563,152 B2
(45) Date of Patent: Feb. 18, 2020

(54) FABRIC CONDITIONING COMPOSITION

(71) Applicant: Colgate-Palmolive Company, New York, NY (US)

(72) Inventors: Charles J. Schramm, Jr., Hillsborough, NJ (US); Katie Truong, Piscataway, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/651,140

(22) PCT Filed: Dec. 11, 2012

(86) PCT No.: PCT/US2012/068963
§ 371 (c)(1),
(2) Date: Jun. 10, 2015

(87) PCT Pub. No.: WO2014/092691
PCT Pub. Date: Jun. 19, 2014

(65) Prior Publication Data
US 2015/0329799 A1 Nov. 19, 2015

(51) Int. Cl.
*C11D 3/00* (2006.01)
*C11D 3/30* (2006.01)
*C11D 1/52* (2006.01)

(52) U.S. Cl.
CPC ..... *C11D 3/001* (2013.01); *C11D 1/521* (2013.01); *C11D 3/30* (2013.01)

(58) Field of Classification Search
CPC ..... C11D 3/001
See application file for complete search history.

(56) References Cited

U.S. PATENT DOCUMENTS 3,954,634 A * 5/1976 Monson ..... C11D 1/62 510/525
5,114,600 A * 5/1992 Biggin ..... C11D 1/40 510/475
5,474,690 A 12/1995 Wahl et al.
5,500,138 A 3/1996 Bacon et al.
5,652,206 A 7/1997 Bacon et al.
6,492,322 B1 12/2002 Cooper et al.
6,737,392 B1 * 5/2004 Keys ..... C11D 1/62 510/276
6,864,223 B2 3/2005 Smith et al.
6,939,844 B2 9/2005 Cooper et al.
6,949,500 B2 * 9/2005 Salesses ..... C11D 1/62 510/475
7,211,556 B2 * 5/2007 Heibel ..... C11D 1/40 510/520
2002/0002297 A1 1/2002 Keys
2003/0087172 A1 * 5/2003 Zhu ..... G03G 5/14769 430/66
2003/0092591 A1 * 5/2003 Ellson ..... C11D 1/835 510/329
2003/0104964 A1 6/2003 Cooper et al.
2003/0114339 A1 * 6/2003 Grainger ..... C11D 1/835 510/329
2004/0116322 A1 * 6/2004 Yianakopoulos ..... C11D 1/62 510/515
2005/0124529 A1 * 6/2005 Liu ..... C07C 233/38 510/499
2005/0233939 A1 * 10/2005 Heibel ..... C11D 1/40 510/515
2006/0167117 A1 * 7/2006 Leaym ..... A61K 8/891 514/310
2006/0252668 A1 * 11/2006 Frankenbach ..... C11D 1/62 510/504
2007/0054835 A1 3/2007 Corona, III et al.
2008/0263780 A1 10/2008 Declercq et al.
2009/0042765 A1 2/2009 Gizaw et al.
2010/0197560 A1 * 8/2010 Nepras ..... A61K 8/416 510/515
2010/0239513 A1 9/2010 Demeyere et al.
2010/0293677 P1 * 11/2010 Maillard ..... A01H 5/0856
2011/0269633 A1 * 11/2011 Bilello ..... G01N 33/6869 506/8
2011/0269663 A1 * 11/2011 Clowes ..... C11D 1/62 510/515
2013/0296220 A1 * 11/2013 Herzig ..... C08L 83/04 510/517

(Continued)

FOREIGN PATENT DOCUMENTS

CN 105860669 8/2016
WO WO 98/012293 3/1998

(Continued)

OTHER PUBLICATIONS

International Search Report and Written Opinion in International Application No. PCT/US2012/068963, dated Sep. 13, 2013.
Written Opinion in International Application No. PCT/US2012/068963, dated Nov. 19, 2014.
Wilks et al., 1996, "Characterization of quaternized triethanol amine esters (esterquats) by HPLC, HRCGC and NMR," 4th World Surfactants Congress, Barcelone, 3-7 VI, p. 382.

*Primary Examiner* — Mark Eashoo
*Assistant Examiner* — M Reza Asdjodi

(57) ABSTRACT

A fabric conditioning composition comprising an emulsion of particles in an aqueous vehicle, the particles comprising (a) an esterquat comprising an alkyl dialkanol amine esterquat of a fatty acid, wherein from at least 90 wt % to up to 100 wt % of the esterquat is comprised of diesterquat and from 0 wt % to up to 10 wt % of the esterquat is comprised of monoesterquat, and the fatty acid is substantially saturated and has an iodine value of less than 5, and (b) a water swellable cationic polymer.

31 Claims, No Drawings

(56) References Cited

U.S. PATENT DOCUMENTS

| | | | | |
|---|---|---|---|---|
| 2015/0329799 | A1* | 11/2015 | Schramm, Jr. ..... | C11D 1/62<br>510/515 |

FOREIGN PATENT DOCUMENTS

| | | | | |
|---|---|---|---|---|
| WO | WO 9812293 | A1 * | 3/1998 | ..... C11D 1/62 |
| WO | WO 04/061065 | | 7/2004 | |
| WO | WO 05/103216 | | 11/2005 | |
| WO | WO 06/113658 | | 10/2006 | |
| WO | WO 07/092020 | | 8/2007 | |
| WO | WO 10/079100 | | 7/2010 | |
| WO | 2011/017090 | | 2/2011 | |

* cited by examiner

FABRIC CONDITIONING COMPOSITION

BACKGROUND OF THE INVENTION

Esterquat, a quaternary ammonium compound, is known for use as a fabric softening molecule. It is typically formed when the reaction product of long chain (C12-C22 or C16-C18) fatty acids and a tertiary amine is esterified in the presence of an acid catalyst and subsequently quaternized to obtain quaternary ammonium salts. The final product is a mixture of mono-, di- and triester components.

Quaternary ammonium compounds exhibiting particularly good fabric softening performance and stability profiles are obtained from reaction of C12-C22 fatty acids or the hydrogenation products, usually containing some degree of unsaturation, having an iodine value range of 20-90.

Triethanol amine (TEA) tallow fatty acid esterquats have been one mainstay for fabric conditioners since the late 1990's. The triesterquat component of triethanol amine (TEA) esterquat has been generally held to have poor softening and fragrance delivery performance. The prior art has generally focused on efforts to enhance the diesterquat component which was claimed to maximize softening efficacy.

The costs of raw materials required for production of triethanol amine based esterquats such as fatty acids and dimethyl sulfate are increasing significantly in line with oil price increases. TEA esterquats are composed of mono-, di-, and tri-esterquats and mono-, di-, and tri-ester amines. This complicated chemistry results in emulsions that contain several types of emulsion structures, some of which do not effectively contribute to softening performance upon dilution in water during the rinse cycle of a fabric washing process because of their high solubility in water. This becomes particularly noticeable in fabric softening compositions in which the initial product active levels are reduced, resulting in less structure in the initial product emulsion.

Another difficulty of this esterquat system is that the complicated chemistry also makes it hard for a formulator to adjust or add other ingredients to the formulation: each emulsion structure reacts in its own way to the formula change and makes it very difficult for the formulator to balance all the different changes.

Another type of esterquat used in fabric conditioners is a methyl diethanol amine (MDEA) esterquat which has a less complicated chemical composition than TEA esterquats. The MDEA esterquat typically contains a blend of the monoesterquat and the diesterquat. Again, a mixture of mono- and diesterquats can cause reduced softening/fragrance delivery efficacy, stability, and formulation problems.

It is known that esterquat compositions having a high percentage of saturated fatty acids, which are known in the art as "hard" fatty acids, may suffer from processing drawbacks.

When used in fabric softening, esterquat compositions are required to provide not only good consumer perceived fabric softness while retaining good fragrance delivery but also good processability during manufacture.

There is therefore a need in the art for an esterquat composition, in particular for use as a fabric softening composition, which can have at least one of lower cost, a less complex formulation and/or manufacturing process, equivalent or higher softening and/or fragrance delivery performance, and consistent and predictable properties and performance as compared to known esterquat compositions.

There is, in particular, a need in the art for an esterquat composition for use in a fabric conditioner which can have a lower cost but at least a substantially equivalent softening and fragrance delivery performance as compared to known esterquat compositions for fabric conditioners.

BRIEF SUMMARY OF THE INVENTION

The present invention accordingly provides a fabric conditioning composition comprising an emulsion of particles in an aqueous vehicle, the particles comprising (a) an esterquat comprising an alkyl dialkanol amine esterquat of a fatty acid, wherein from at least 90 wt % to up to 100 wt % of the esterquat is comprised of diesterquat and from 0 wt % to up to 10 wt % of the esterquat is comprised of monoesterquat, and the fatty acid is substantially saturated and has an iodine value of less than 5, and (b) a water swellable cationic polymer.

In certain embodiments, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (i).

The amount of diesterquat is at least 90 wt % of the esterquat, optionally at least 95 wt % of the esterquat, further optionally at least 99 wt % of the esterquat.

Optionally, from 0 wt % to up to 5 wt %, typically from 0 wt % to up to 1 wt %, of the esterquat is comprised of monoesterquat.

Optionally, the alkanol amine comprises diethanol amine.

Optionally, the fatty acid comprises tallow. However, in any of the embodiments of the invention the fatty acid may comprises any fatty acid having from 12 to 22 carbon atoms, typically from 16 to 18 carbon atoms.

Optionally, the alkyl dialkanol amine esterquat of a fatty acid comprises a methyl dialkanol amine esterquat of a fatty acid.

Optionally, the tallow fatty acid has a degree of saturation, based on the total weight of fatty acids, of from 97 to 100%. Optionally, the tallow fatty acid has an iodine value of from zero to up to 3.

Optionally, the cationic linear copolymer (i) is derived from the polymerization of a salt of methacrylic acid and acrylamide.

Optionally, in the polymerization of the cationic linear copolymer (i) the salt comprises a quaternary ammonium salt of an acrylate or methacrylate, further optionally a quaternary ammonium salt of dimethyl aminoethyl methacrylate.

Optionally, the cationic linear copolymer (i) has a molecular weight of from about 2 million to about 3 million.

Optionally, the cationic cross-linked polymer (ii) is derived from the polymerization using 75 to 200 ppm of the cross-linking agent, further optionally using 80 to 150 ppm of the cross-linking agent.

Optionally, the cationic cross-linked polymer (ii) is derived from the polymerization of a salt of methacrylic acid and acrylamide.

Optionally, in the polymerization of the cationic cross-linked polymer (ii) the salt comprises a quaternary ammonium salt of an acrylate or methacrylate, further optionally a quaternary ammonium salt of dimethyl aminoethyl methacrylate.

Optionally, in the polymerization of the cationic cross-linked polymer (ii), the polymer prior to cross-linking has a molecular weight of from about 2 million to about 3 million.

Optionally, in the polymerization of the cationic cross-linked polymer (ii), the cross-linker comprises methylene bis-acrylamide.

Optionally, the composition comprises from 1.5 to 5 wt % diesterquat, further optionally from 2 to 3 wt % diesterquat, still further optionally about 2.5 wt % diesterquat, based on the weight of the composition.

Optionally, the composition comprises from 0.05 to 0.5 wt % of the water swellable cationic polymer, further optionally from 0.1 to 0.5 wt % of the water swellable cationic polymer, still further optionally 0.15 to 0.35 wt % or 0.2 to 0.25 wt % of the water swellable cationic polymer, based on the weight of the composition.

Optionally, the weight ratio of diesterquat to the water swellable cationic polymer is from 30:1 to 5:1, optionally from 25:1 to 10:1, further optionally from 25:1 to 12.5:1, yet further optionally about 25:1 or about 12.5:1.

The composition may optionally further comprise a fragrance, and further optionally the fragrance is present in an amount of from 0.25 to 1 wt % fragrance, still further optionally from 0.2 to 0.4 wt % fragrance, based on the weight of the composition.

Optionally, the composition may further comprise a plurality of capsules encapsulating some of the fragrance. Optionally, the capsules are present in an amount of from 0.1 to 0.5 wt %, based on the weight of the composition. Optionally, the fragrance and capsules are present in weight ratio of from 2:1 to 1:2.

Optionally, the particles have an average particle size of from 0.1 to 2 microns, further optionally from 0.1 to 1 microns.

The present invention also provides a method of producing a fabric conditioning composition, the method comprising the steps of:

a. providing an emulsion of the particles in an aqueous vehicle; and
b. homogenizing the emulsion by passing the emulsion through a homogenizer at a pressure of from $2.1\times10^7$ to $1.03\times10^8$ Pa (3,000 to 15,000 psi) to form a homogenized emulsion.

Optionally, the homogenizing step (b) is carried out at a pressure of from $3.4\times10^7$ to $8.9\times10^7$ Pa (5,000 to 13,000 psi), optionally $6.9\times10^7$ to $8.3\times10^7$ Pa (10,000 to 12,000 psi).

Optionally, the homogenized emulsion comprises particles having an average particle size of from 0.1 to 2 microns, further optionally from 0.1 to 1 microns.

Optionally, in the homogenizing step (b) the emulsion is at a temperature of from 30 to 75° C., further optionally from 50 to 60° C.

Optionally, the emulsion provided in step (a) is produced by a method comprising the steps of: i. dispersing the water swellable cationic polymer into water at a temperature of from 30 to 75° C. and mixing to form an aqueous dispersion; ii. adding the diesterquat to the aqueous dispersion; and iii. mixing the resultant mixture to produce the composition in which the diesterquat is dispersed as an aqueous emulsion, and the aqueous emulsion comprises particles including a mixture of the triesterquat and the water swellable cationic polymer.

Optionally, in step i the water is at a temperature of from 50 to 60° C.

Optionally, in step iii the mixing is carried out for a period of from 1 to 4 minutes using a shearing mixer to form the emulsion.

Optionally, in step ii the esterquat is dispersed into the water in the form of a molten liquid.

Optionally, the molten liquid includes fragrance. Optionally, the fragrance is present in an amount of from 0.25 to 1 wt % fragrance, further optionally from 0.2 to 0.4 wt % fragrance, based on the weight of the composition.

Optionally, the method further comprises a plurality of capsules encapsulating some of the fragrance. Optionally, the capsules are present in an amount of from 0.1 to 0.5 wt %, based on the weight of the composition. Optionally, the fragrance and capsules are present in weight ratio of from 2:1 to 1:2.

Optionally, the esterquat may have the same composition and concentration as described above in the composition of the invention. Optionally, the water swellable cationic polymer may have the same composition and concentration as described above in the composition of the invention. The weight ratio of diesterquat to the water swellable cationic polymer may be as described above in the composition of the invention.

The present invention also provides a method of softening a fabric comprising treating the fabric with a composition of the invention or produced by a method of the invention.

Optionally, the composition further comprises a fragrance and the method provides fragrance delivery onto the fabric.

The present invention also provides the use of a composition of the invention or produced by a method of the invention as a fabric softener.

The present invention is at least partly predicated on the finding by the present inventors that the combination of a esterquat comprising an alkyl dialkanol amine esterquat of a substantially saturated, "hard", fatty acid and a cationic cross-linked polymer as identified above as an effective dispersion aid for the esterquat can provide a stable aqueous emulsion of the esterquat which is effective in providing enhanced softening performance and fragrance delivery at low active component levels, in particular low active AI amounts of esterquat, cationic cross-linked polymer and fragrance. In addition, the composition may be homogenized at high pressure to provide a very small average particle size, even as low as 0.1 to 1 microns, which exhibits enhanced softening performance and fragrance delivery at low active component levels, and enhanced emulsion stability.

In particular, the inventors found that an MDEA esterquat with a high softening efficacy could be provided by a highly saturated fatty acid diesterquat, which was stabilized by the water swellable cationic polymer and homogenized at high pressure to provide a very small emulsion particle size which exhibited high softening efficacy and fragrance delivery.

This hard MDEA esterquat composition would be expected to have low emulsion stability and dispersibility, yet by combining the diesterquat with the water swellable cationic polymer in accordance with the preferred embodiments of the invention, the stability and performance of the diesterquat can be significantly enhanced, to provide a technically and commercially acceptable esterquat fabric conditioning composition.

DETAILED DESCRIPTION OF THE INVENTION

AI refers to the active weight of the combined amounts for monoesterquat and diesterquat.

Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally.

The present invention accordingly provides a fabric conditioning composition comprising an emulsion of particles in an aqueous vehicle, the particles comprising (a) an esterquat comprising an alkyl dialkanol amine esterquat of a fatty acid, wherein from at least 90 wt % to up to 100 wt % of the esterquat is comprised of diesterquat and from 0 wt % to up to 10 wt % of the esterquat is comprised of monoesterquat, and the fatty acid is substantially saturated and has an iodine value of less than 5, and (b) a water swellable cationic polymer.

In certain embodiments, the water swellable cationic polymer has a charge density of 4 to 5 meq/g. In other embodiments, the charge density is 4 to 4.5, 4 to less than 4.5, about 4.5, 4.5 to 5, or greater than 4.5 to 5 meq/g.

In one embodiment, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (i).

The term "alkyl dialkanol amine esterquat", of which "MDEA esterquat" is an example, used in the present invention to denote an esterquat having the following structural formula:

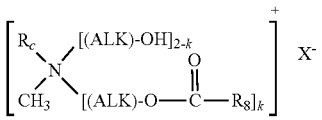

in which $R_B$ is individually selected from the group consisting of straight or branched chain, optionally substituted alkyl groups having from 11 to 23 carbon atoms; ALK is an alkylene having from 2 to about 6 carbon atoms; k=1 for the monoesterquat or 2 for the diesterquat; $R_C$ is a C1-C4, preferably a C1-C3, alkyl, or a C7-C10 aralkyl; and $X^-$ is a softener compatible anion such as a halogen, $CH_3SO_4^-$ or $C_2H_5SO_4^-$. Preferably, $R_B$ is individually selected from the group consisting of straight or branched chain, optionally substituted alkyl groups having from 11-21 carbon atoms; ALK is $C_2H_4$; $R_C$ is methyl; and $X^-$ is an anion such as $Cl^-$, $CH_3SO_4^-$, and $C_2H_5SO_4^-$.

The alkyl alkanol amine esterquat, typically MDEA esterquat, is typically produced by reacting a fatty acid alkyl ester with dialkanol amine followed by quaternization with dimethyl sulfate. In certain embodiments, the dialkanol amine comprises diethanol amine. Optionally, the alkyl dialkanol amine esterquat of a fatty acid comprises a methyl dialkanol amine esterquat of a fatty acid.

The fatty acids can be any fatty acid that is used for manufacturing esterquats for fabric softening. In any of the embodiments of the invention the fatty acid may comprises any fatty acid having from 12 to 22 carbon atoms, typically from 16 to 18 carbon atoms. Examples of fatty acids include, but are not limited to, coconut oil, palm oil, tallow, rape oil, fish oil, or chemically synthesized fatty acids. In certain embodiments, the fatty acid is tallow.

In accordance with the invention, the reaction is carried out so as to have a high amount of diesterquat, and a low amount of monoesterquat.

In some embodiments, from 0 wt % to up to 5 wt %, typically from 0 wt % to up to 1 wt %, of the esterquat is comprised of monoesterquat. The amount of diesterquat is at least 90 wt % of the esterquat, optionally at least 95 wt % of the esterquat, further optionally at least 99 wt % of the esterquat.

The selection of a particular molar ratio between the fatty acid methyl ester with dialkanol amine controls the amount of each of monoesterquat and diesterquat in the composition. By selecting a ratio of about 2:1, the diesterquat can be maximized while decreasing or minimizing the monoesterquat.

The percentages, by weight, of mono and di esterquats, as described above are determined by the quantitative analytical method described in the publication "Characterisation of quaternized triethanol amine esters (esterquats) by HPLC, HRCGC and NMR" A. J. Wilkes, C. Jacobs, G. Walraven and J. M. Talbot—Colgate Palmolive R&D Inc.—4$^{th}$ world Surfactants Congress, Barcelone, 3-7 VI 1996, page 382. The percentages, by weight, of the mono and di esterquats measured on dried samples are normalized on the basis of 100%. The normalization is required due to the presence of a small percentage, by weight, of non-quaternized species, such as ester amines and free fatty acids. Accordingly, the normalized weight percentages refer to the pure esterquat component of the raw material. In other words, for the weight % of each of monoesterquat and diesterquat, the weight % is based on the total amount of monoesterquat and diesterquat in the composition.

In certain embodiments, the fatty acids are substantially fully hydrogenated so as to be substantially saturated, and are referred to in the art as "hard" fatty acids. Typically the fatty acids, such as the tallow fatty acid, have a degree of saturation, based on the total weight of fatty acids, of from 97 to 100%. Optionally, the tallow fatty acid has an iodine value of from zero to up to 3. The iodine value can be measured by ASTM D5554-95 (2006).

The percentage of saturated fatty acids can be achieved by using a mixture of fatty acids to make the esterquat, or the percentage can be achieved by blending esterquats with different amounts of saturated fatty acids.

At higher AI levels, larger amounts of saturated fatty acids deliver more noticeable results than lower AI levels because the absolute amount of saturated fatty acid is greater, which provides a noticeable difference. While there is still a difference in result at lower AI, the result is less noticeable.

In certain embodiments, the amount of esterquat in the composition is up to 15% by weight, optionally up to 10%, up to 9%, up to 8%, up to 7%, up to 6%, or up to 5% by weight. In certain embodiments, the amount is 0.01 to 15%, 1 to 10%, 1 to 8%, 1 to 5%, 1.5 to 5%, or 2 to 3.5% by weight, preferably 1.5 to 5% or 2 to 3.5% by weight.

In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

In certain embodiments, the composition comprises from 1.5 to 5 wt % diesterquat, further optionally from 2 to 3 wt % diesterquat, based on the weight of the composition. In some embodiments, the composition comprises about 2.5 wt % diesterquat, based on the weight of the composition.

While the esterquat can be provided in solid form, it is usually present in a solvent in liquid form. In certain embodiments, the solvent comprises water.

Substantially fully hydrogenated diesterquat is not highly soluble in water. The water swellable cationic polymer is provided to increase the dispersibility of the diesterquat in the water so that the esterquat forms particles of an aqueous emulsion which has stability prior to use and can be delivered to fabric during use to effect fabric softening.

In embodiments the cationic surface charge of the emulsion particle, enhanced by the water swellable cationic polymer, assures that the emulsion particle may exhibit effective fabric deposition during the rinse process.

The water swellable cationic polymer employed in the preferred embodiments has good solubility in water and good biodegradability.

In certain embodiments, the cationic cross-linked polymer is derived from the polymerization using 75 to 200 ppm of the cross-linking agent, further optionally 80 to 150 ppm of the cross-linking agent. In certain embodiments, the cationic cross-linked polymer is derived from the polymerization of a salt of methacrylic acid and acrylamide. In certain embodiments, in the polymerization of the cationic cross-linked polymer the salt comprises a quaternary ammonium salt of an acrylate or methacrylate, typically a quaternary ammonium salt of dimethyl aminoethyl methacrylate. In certain embodiments, in the polymerization of the cationic cross-linked polymer, the polymer prior to cross-linking has a molecular weight of from about 2 million to about 3 million. In certain embodiments, in the polymerization of the cationic cross-linked polymer, the cross-linker comprises methylene bis acrylamide. In certain embodiments, the water swellable cationic polymer is available in commerce from SNF Floerger under the trade name Flosoft 200.

In certain embodiments, the composition comprises from 0.05 to 0.5 wt % of the water swellable cationic polymer, for example from 0.1 to 0.5 wt % of the water swellable cationic polymer, typically from 0.15 to 0.35 wt % or 0.2 to 0.25 wt % of the water swellable cationic polymer, based on the weight of the composition.

In certain embodiments, the weight ratio of diesterquat to the water swellable cationic polymer is from 30:1 to 5:1, optionally from 25:1 to 10:1, further optionally from 25:1 to 12.5:1, yet further optionally about 25:1 or about 12.5:1.

The composition can be provided as a fragrance free composition, or it can contain a fragrance. The amount of fragrance can be any desired amount depending on the preference of the user. In certain embodiments, the composition further comprises from 0.25 to 1 wt % fragrance, typically from 0.2 to 0.4 wt % fragrance, based on the weight of the composition.

The composition may further comprise a plurality of capsules encapsulating some of the fragrance. In certain embodiments, the capsules are present in an amount of from 0.1 to 0.5 wt %, based on the weight of the composition. In certain embodiments, the fragrance and capsules are present in weight ratio of from 2:1 to 1:2. Typically, capsule loading is around 45 weight % fragrance oil.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

In certain embodiments, the diesterquat is dispersed as an aqueous emulsion which comprises particles including a mixture of the diesterquat and the water swellable cationic polymer.

In certain embodiments, the particles have an average particle size of from 1 to 2 microns, typically from 0.1 to 1 microns.

The fabric conditioners may additionally contain a thickener.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis(methylenephosphonic acid); 1-hydroxyethane 1,1-diphosphonic acid (HEDP); and aminotri(methylenephosphonic acid). In certain embodiments, the composition can include amino trimethylene phosphonic acid, which is available as Dequest™ 2000 from Monsanto.

In certain embodiments, the composition can include a C13-C15 Fatty Alcohol EO 20:1, which is a nonionic surfactant with 20 an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

The composition can be used to soften fabrics by treating the fabric with the composition. This can be done during the rinse cycle of a wash using a liquid fabric softener.

The present invention also provides a method of producing a fabric conditioning composition, the method comprising the steps of:

a. providing an emulsion of particles in an aqueous vehicle; and
b. homogenizing the emulsion by passing the emulsion through a homogenizer at a pressure of from $2.1\times10^7$ to $1.03\times10^8$ Pa (3,000 to 15,000 psi) to form a homogenized emulsion.

In certain embodiments, the homogenizing step (b) is carried out at a pressure of from $3.4\times10^7$ to $8.9\times10^7$ Pa (5,000 to 13,000 psi), optionally $6.9\times10^7$ to $8.3\times10^7$ Pa (10,000 to 12,000 psi).

In certain embodiments, the homogenized emulsion comprises particles having an average particle size of from 0.1 to 2 microns, further optionally from 0.1 to 1 microns.

Optionally, in the homogenizing step (b) the emulsion is at a temperature of from 30 to 75° C., further optionally from 50 to 60° C.

In certain embodiments, the emulsion provided in step (a) is produced by a method comprising the steps of: i. dispersing the water swellable cationic polymer into water at a temperature of from 30 to 75° C. and mixing to form an aqueous dispersion; ii. adding the diesterquat to the aqueous dispersion; and iii. mixing the resultant mixture to produce the composition in which the diesterquat is dispersed as an aqueous emulsion, and the aqueous emulsion comprises particles including a mixture of the triesterquat and the water swellable cationic polymer.

In certain embodiments, in step i the water is at a temperature of from 50 to 60° C.

In certain embodiments, in step iii the mixing is carried out for a period of from 1 to 4 minutes using a shearing mixer to form the emulsion.

In certain embodiments, in step ii the esterquat is dispersed into the water in the form of a molten liquid.

In certain embodiments, the molten liquid includes fragrance. In certain embodiments, the fragrance is present in an amount of from 0.25 to 1 wt % fragrance, further optionally from 0.2 to 0.4 wt % fragrance, based on the weight of the composition.

In certain embodiments, the method further comprises a plurality of capsules encapsulating some of the fragrance. In certain embodiments, the capsules are present in an amount of from 0.1 to 0.5 wt %, based on the weight of the composition. In certain embodiments, the fragrance and capsules are present in weight ratio of from 2:1 to 1:2.

In certain embodiments, the esterquat may have the same composition and concentration as described above in the composition of the invention. In certain embodiments, the water swellable cationic polymer may have the same composition and concentration as described above in the composition of the invention. The weight ratio of diesterquat to the water swellable cationic polymer may be as described above in the composition of the invention.

The present invention also provides a method of softening a fabric comprising treating the fabric with a composition of the invention or produced by a method of the invention.

In certain embodiments, the composition further comprises a fragrance and the method provides fragrance delivery onto the fabric.

The present invention also provides the use of a composition of the invention or produced by a method of the invention as a fabric softener.

The composition can contain any material that can be added to fabric softeners. Examples of materials include, but are not limited to, surfactants, thickening polymers, colorants, clays, buffers, silicones, fatty alcohols, and fatty esters.

SPECIFIC EMBODIMENTS OF THE INVENTION

The invention is further described in the following examples. The examples are merely illustrative and do not in any way limit the scope of the invention as described and claimed.

EXAMPLE 1

In Example 1 a fabric conditioner composition based on methyl diethanol amine tallow fatty acid diesterquat was prepared.

In Example 1, deionized water was provided at a temperature of 75° C. A water swellable cationic polymer which was a FS200-type polymer from SNF having the trade name Flosoft DP200 available in commerce from SNF Floerger. A buffer in the form of lactic acid was provided. A chelating compound having the formula aminotri(methylenephosphonic acid) in the form of a commercially available chelating compound known under the trade name Dequest 2000 from Monsanto was also provided. The water swellable cationic polymer (0.1 wt %), buffer (0.071 wt %), and chelating compound (0.1 wt %) were added to the water (95.429 wt %), all percentages being with respect to the final composition, and mixed under high shear for 2 minutes.

Then powdered hard tallow methyl diethanol amine (MDEA) esterquat, comprising at least 90 wt % diesterquat and no more than 10 wt % monoesterquat, admixed with fragrance, was added to the aqueous solution of buffer and chelating agent. The fatty acid had an iodine value (IV) of 3.

The MDEA esterquat was added in an amount so as to comprise 4 wt % of the final composition. The fragrance was added in an amount so as to comprise 0.3 wt % of the final composition. The resultant mixture was mixed using the high shear mixer for a further period of 4 minutes.

Thereafter, the resultant emulsion, at a temperature of 55° C., was passed through a high pressure homogenizer at a pressure of $3.44\times10^7$ Pa (5,000 psi).

This formed in Example 1 a stable aqueous emulsion of particles of the mixture of the MDEA esterquat and the water swellable cationic polymer. The emulsion particles had an average particle size of from 1 to 2 microns. All particle size measurements were carried out using a Malvern 2000 Mastersizer. The volume average particle size is reported.

The product of the method of Example 1 was used as a fabric softening composition which was employed in a fabric softening test using four different amounts in a wash/rinse cycle. The Protocol for the test is described below.

Protocol

Full Load Wash in Standard US Type Washer

Each experiment used 79 grams product added to the rinse after a wash cycle with 90 grams anionic surfactant based detergent. The fabric load consisted of 12 terry hand towels (approximately 1.4 Kg) and a mixed clothing load (approximately 1.6 Kg). There was a 15 minute wash cycle and a 4 minute rinse cycle. All terry towels were line dried. A subset of the towels were cut into smaller pieces and evaluated by a trained sensory panel for their fragrance intensity on a scale from 1 to 10. Whole towels were folded and evaluated by a trained sensory panel for their softness intensity on a scale from 1 to 10. Positive (a current commercial fabric softener product) and negative (no softener in rinse) controls were used in the screening tests. Each experiment consisted of the positive and negative controls and 4 experimental products. The rated performance of the positive control can vary somewhat from day to day showing variability of both performance and rating from day to day.

In Example 1, Test 1 used 110 grams of the fabric softening composition, to provide 4.4 grams of active MDEA esterquat delivered in the rinse. Correspondingly, Tests 2 and 3 used 55 and 28 grams of the fabric softening composition, to provide, respectively, 2.2 and 1.1 grams of active MDEA esterquat delivered in the rinse.

The softness results of the tested composition at different AI values were determined as described above, and evaluated against a control fabric softening composition comprising triethanol amine esterquat (TEA) at a 4 wt % active amount dosed at 110 grams per wash. The control TEA esterquat included the same fragrance as the composition of Example 1, and in an amount so that equal AI amounts of the composition of Example 1 and the control composition had similar fragrance AI amounts too.

The results are shown in Table 1. In Table 1 a rating value of 0 means equal to the control TEA, a rating value with a + means more intense than the control TEA and a rating value with a − means less intense than the control TEA. Within + or −1, the values are parity.

TABLE 1

| Example 1 | Softener composition Delivered AI in rinse | Softness | Fragrance Day 1 Unrubbed | Fragrance Day 1 Rubbed |
|---|---|---|---|---|
| Test 1 | 4.4 | +1.55 | +0.2 | +1.3 |
| Test 2 | 2.2 | −0.80 | −0.2 | −0.1 |
| Test 3 | 1.1 | −1.20 | −1.7 | −1.8 |

Table 1 shows that for the MDEA esterquat the composition could provide softness equivalency to TEA esterquat with a delivered AI for the MDEA esterquat at about one half of the delivered AI of the TEA esterquat.

The fragrance delivery was also tested by the tester panel. The tests included both rubbing and not rubbing the fabric at day 1. The results are also shown in Table 1.

At a delivered AI of about 2 in Test 2, which was about one half of the delivered AI of about 4 for the control TEA esterquat, the fragrance delivery was substantially the same as that for the control, despite there correspondingly being a corresponding fragrance delivered AI concentration of about one half that of the control.

EXAMPLES 2 TO 6

In Examples 2 to 6, the method of Example 1 was repeated to produce a number of different compositions. However, the method was changed so that the homogenization pressure was $6.89\times10^7$ Pa (10,000 psi). This higher pressure produced a reduced emulsion average particle size of from 0.1 to 1 microns.

In these Examples, the homogenized composition comprised 2.5 wt % of the same hard tallow MDEA esterquat as in Example 1. Also, the fragrance amount varied from Examples 2 to 5. In Examples 2 to 5 the fragrance amount was 0.2. 0.3, 0.4 or 0.5 wt % respectively. The fragrance was present as free (i.e. un-encapsulated) fragrance. In Example 6, the fragrance was zero, but with the same 2.5 wt % hard tallow MDEA esterquat.

The composition of each of Examples 2 to 6 were tested to determine the ability of the compositions to deliver fragrance and provide fragrance intensity onto fabric on day one and to soften the fabric. The results are shown in Table 2.

TABLE 2

| | Composition | Day 1 Fragrance | Softness |
|---|---|---|---|
| Example 2 | 2.5 wt % MDEA esterquat/0.1 wt % FS200 type/0.2 wt % free fragrance | 3.25 | 4.8 |
| Example 3 | 2.5 wt % MDEA esterquat/0.1 wt % FS200 type/0.3 wt % free fragrance | 3.8 | 6.1 |
| Example 4 | 2.5 wt % MDEA esterquat/0.1 wt % FS200 type/0.4 wt % free fragrance | 3.3 | 7.65 |
| Example 5 | 2.5 wt % MDEA esterquat/0.1 wt % FS200 type/0.5 wt % free fragrance | 3.55 | 5.45 |

TABLE 2-continued

| | Composition | Day 1 Fragrance | Softness |
|---|---|---|---|
| Example 6 | 2.5 wt % MDEA esterquat/0.1 wt % FS200 type/no fragrance | 2.0 | 2.65 |

In this Example, it is shown that the homogenized MDEA esterquat can provide softness and fragrance delivery performance.

EXAMPLES 7 TO 11

In Examples 7 to 10, the compositions of Examples 2 to 5 were modified by the incorporation of fragrance capsules to encapsulate the fragrance in the respective compositions. The fragrance capsules are added as a capsule slurry to the composition together with the fragrance prior to homogenization in an amount of 0.3 wt % based on the weight of the final composition. Example 11, like Example 6, included no fragrance, but did include the fragrance capsules.

The composition of each of Examples 7 to 11 were tested to determine the ability of the compositions to deliver fragrance and provide fragrance intensity onto fabric on day one, tested without rubbing, and to soften the fabric. The results are shown in Table 3.

TABLE 3

| | Composition | Day 1 Fragrance | Softness |
|---|---|---|---|
| Example 7 | 2.5 wt % MDEA esterquat/0.1 wt % FS200 water swellable cationic polymer/0.2 wt % fragrance/0.3 wt % fragrance booster capsules | 5.8 | 6.1 |
| Example 8 | 2.5 wt % MDEA esterquat/0.1 wt % FS200 water swellable cationic polymer/0.3 wt % fragrance/0.3 wt % fragrance booster capsules | 3.35 | 6.3 |
| Example 9 | 2.5 wt % MDEA esterquat/0.1 wt % FS200 water swellable cationic polymer/0.4 wt % fragrance/0.3 wt % fragrance booster capsules | 4.45 | 4.95 |
| Example 10 | 2.5 wt % MDEA esterquat/0.1 wt % FS200 water swellable cationic polymer/0.5 wt % fragrance/0.3 wt % fragrance booster capsules | 4.55 | 6.05 |
| Example 11 | 2.5 wt % MDEA esterquat/0.1 wt % FS200 water swellable cationic polymer/no fragrance/0.3 wt % fragrance booster capsules | 2.15 | 2.5 |

In these Examples it is shown that the homogenized MDEA esterquat can provide softness and fragrance delivery performance.

EXAMPLES 12 TO 14

In these Examples, a fabric conditioner composition based on methyl diethanol amine (MDEA) tallow fatty acid diesterquat was prepared.

In Example 12, the MDEA esterquat fabric conditioner composition was prepared as described in Example 1 except that a cationic cross-linked water swellable cationic polymer having formula as described above was provided in the form of a commercially available FS200-type polymer from SNF having the trade name Flosoft DP200 and added to the deionized water together with the buffer and chelating compound. The water swellable cationic polymer was present in an amount of 0.2 wt % with respect to the final composition. Therefore the water swellable cationic polymer was added prior to the high pressure homogenization. The fragrance was added in an amount so as to comprise 0.2 wt % of the final composition and the high pressure homogenizer was at a pressure of $7.6\times10^7$ Pa (11,000 psi). Again, the final particle size was from 0.1 to 1 microns.

In Example 13, the MDEA esterquat fabric conditioner composition was prepared as described in Example 12 except that the fragrance concentration was increased to 0.3 wt % from 0.2 wt %.

The compositions of Examples 12 to 13 were tested for softening performance and fragrance delivery intensity at day 1 and day 7 in a similar manner to Examples 2 to 5. A first series of tests was carried out on the compositions of Example 12 and a control wash/rinse with no softener. A second series of tests was carried out on the compositions of Example 13 and a control wash/rinse with no softener. The results are shown in Tables 4 to 5.

TABLE 4

| | Composition | Softness | Day 1 Fragrance | Day 7 Fragrance |
|---|---|---|---|---|
| Example 12 | 2.5 wt % MDEA esterquat/0.2 wt % free fragrance/0.2 wt % FS200 water swellable cationic polymer | 7.15 | 3.55 | 4.4 |
| Control - no softener | N/A | 3.75 | 3.05 | 2.8 |

TABLE 5

| | Composition | Softness | Day 1 Fragrance | Day 7 Fragrance |
|---|---|---|---|---|
| Example 13 | 2.5 wt % MDEA esterquat/0.3 wt % free fragrance/0.2 wt % FS200 water swellable cationic polymer | 7.4 | 3.9 | 3.95 |
| Control - no softener | N/A | 2.8 | 1.9 | 2.0 |

The data in Tables 4 and 5 show that the MDEA esterquat can provide softness and fragrance delivery performance.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

We claim:

1. A fabric conditioning composition comprising an emulsion of particles having an average particle size of from 0.1 to 2 microns in an aqueous vehicle, the particles comprise (a) an esterquat comprising an alkyl dialkanol amine esterquat of a fatty acid, wherein from at least 90 wt % to up to 100 wt % of the esterquat is comprised of diesterquat and from 0 wt % to up to 10 wt % of the esterquat is comprised of monoesterquat, and the fatty acid is substantially saturated and has an iodine value of less than 5, and (b) a water swellable cationic polymer, which consists essentially of at least one of (i) a cationic linear copolymer that is derived from the polymerization of acrylic acid and/or methacrylic acid, or a salt of acrylic acid and/or methacrylic acid, and acrylamide or methacrylamide; and (ii) a cationic cross-linked polymer that is derived from the polymerization of cationic vinyl addition monomer, acrylamide, and a difunctional vinyl addition monomer cross linking agent; or a mixture of polymers (i) and (ii);

wherein the composition comprises from 0.25 to 0.5 wt % of the water swellable cationic polymer, based on the weight of the composition, and wherein the composition comprises from 0.3 to 0.4% free fragrance based on the weight of the composition.

2. The composition of claim 1, wherein from 0 wt % to up to 5 wt % of the esterquat is comprised of monoesterquat.

3. The composition of claim 1, wherein the dialkanol amine comprises diethanol amine.

4. The composition of claim 1, wherein the fatty acid comprises tallow.

5. The composition of claim 1, wherein alkyl dialkanol amine esterquat of a fatty acid comprises a methyl dialkanol amine esterquat of a fatty acid.

6. The composition of claim 1, wherein the fatty acid has a degree of saturation, based on the total weight of fatty acids, of from 97 to 100%.

7. The composition of claim 1, wherein the fatty acid has an iodine value of from zero to up to 3.

8. The composition of claim 1, wherein the alkyl dialkanol amine esterquat is present in an amount of 0.01 to 15% by weight of the composition.

9. The composition of claim 1, wherein the water swellable cationic polymer has a charge density of 4 to 5 meq/g.

10. The composition of claim 1, wherein (i) the cationic linear copolymer has a molecular weight of from about 10,000 to about 30 million; and (ii) the cationic cross-linked polymer is derived from the polymerization of from 5 to 100 mole percent of cationic vinyl addition monomer, from 0 to 95 mole percent of acrylamide, and from 70 ppm to 300 ppm of the difunctional vinyl addition monomer cross linking agent.

11. The composition of claim 10, wherein the cationic linear copolymer (i) is derived from the polymerization of a salt of methacrylic acid and acrylamide.

12. The composition of claim 10, wherein in the polymerization of the cationic linear copolymer (i) the salt comprises a quaternary ammonium salt of an acrylate or methacrylate.

13. The composition of claim 10, wherein the cationic linear copolymer (i) has a molecular weight of from about 2 million to about 3 million.

14. The composition of claim 10, wherein the cationic cross-linked polymer (ii) is derived from the polymerization using 75 to 200 ppm of the cross-linking agent.

15. The composition of claim 10, wherein the cationic cross-linked polymer (ii) is derived from the polymerization of a salt of methacrylic acid and acrylamide.

16. The composition of claim 15, wherein in the polymerization of the cationic cross-linked polymer (ii) the salt comprises a quaternary ammonium salt of an acrylate or methacrylate.

17. The composition of claim 10, wherein in the polymerization of the cationic cross-linked polymer (ii), the polymer prior to cross-linking has a molecular weight of from about 2 million to about 3 million.

18. The composition of claim 10, wherein in the polymerization of the cationic cross-linked polymer (ii), the cross-linker comprises methylene bis acrylamide.

19. The composition of claim 1, wherein the composition comprises from 1.5 to 5 wt % diesterquat, based on the weight of the composition.

20. The composition of claim 1, wherein the weight ratio of diesterquat to the water swellable cationic polymer is from 30:1 to 5:1.

21. A method of producing a fabric conditioning composition according to claim 1, the method comprising the steps of:

a. providing the emulsion of particles; and b. homogenizing the emulsion by passing the emulsion through a homogenizer at a pressure of from $2.1\times10^7$ to $1.03\times10^8$ Pa (3,000 to 15,000 psi) to form a homogenized emulsion.

22. The method of claim 21 wherein the homogenizing step (b) is carried out at a pressure of from $3.4\times10^7$ to $8.9\times10^7$ Pa (5,000 to 13,000 psi).

23. The method of claim 21, wherein the homogenized emulsion comprises particles having an average particle size of from 0.1 to 2 microns.

24. The method of claim 21, wherein in the homogenizing step (b) the emulsion is at a temperature of from 30 to 75° C.

25. The method of claim 21, wherein the emulsion provided in step (a) is produced by a method comprising the steps of:

i. dispersing the water swellable cationic polymer into water at a temperature of from 30 to 75° C. and mixing to form an aqueous dispersion;

ii. adding the diesterquat to the aqueous dispersion; and iii. mixing the resultant mixture to produce the composition in which the diesterquat is dispersed as an aqueous emulsion, and the aqueous emulsion comprises particles including a mixture of the triesterquat and the water swellable cationic polymer.

26. The method of claim 25, wherein in step i the water is at a temperature of from 50 to 60° C.

27. The method of claim 26, wherein in step ii the esterquat is dispersed into the water in the form of a molten liquid.

28. The method of claim 25, wherein in step iii the mixing is carried out for a period of from 1 to 4 minutes using a shearing mixer to form the emulsion.

29. The method of claim 21 wherein the composition further comprises a fragrance and the method provides fragrance delivery onto the fabric.

30. The composition of claim 1, wherein the water swellable cationic polymer comprises a FS200-type polymer such as Flosoft DP200.

31. A method of softening a fabric with the composition according to claim 1 comprising: (1) providing a fabric conditioning composition; (2) adding a fragrance to the fabric conditioning composition; (3) treating the fabric with the fabric conditioning composition during a rinse cycle of a washing process; and (4) improving the softness of the fabric to a level higher than that would be using the fabric conditioning composition without the added fragrance.

* * * * *